US010914040B2

(12) United States Patent
Hofstaetter et al.

(10) Patent No.: US 10,914,040 B2
(45) Date of Patent: Feb. 9, 2021

(54) METHOD FOR COMPACTING THE BALLAST BED OF A TRACK, AND TAMPING UNIT

(71) Applicant: Plasser & Theurer Export von Bahnbaumaschinen Gesellschaft m.b.H., Vienna (AT)

(72) Inventors: Josef Hofstaetter, Puchenau (AT); Thomas Philipp, Leonding (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 209 days.

(21) Appl. No.: 16/064,608

(22) PCT Filed: Dec. 29, 2016

(86) PCT No.: PCT/EP2016/002185

§ 371 (c)(1),
(2) Date: Jun. 21, 2018

(87) PCT Pub. No.: WO2017/129215

PCT Pub. Date: Aug. 3, 2017

(65) Prior Publication Data

US 2019/0055698 A1 Feb. 21, 2019

(30) Foreign Application Priority Data

Jan. 26, 2016 (AT) ..... A 34/2016

(51) Int. Cl.
*E01B 27/16* (2006.01)
*E01B 27/13* (2006.01)

(52) U.S. Cl.
CPC ..... *E01B 27/16* (2013.01); *E01B 27/13* (2013.01); *E01B 2203/12* (2013.01)

(58) Field of Classification Search
CPC ..... E01B 27/12; E01B 27/13; E01B 27/14; E01B 27/16; E01B 2203/12; E01B 2203/127
See application file for complete search history.

(56) References Cited

U.S. PATENT DOCUMENTS 4,010,692 A * 3/1977 Goel ..... E01B 27/16 104/12
4,111,129 A * 9/1978 von Beckmann ..... E01B 27/16 104/10
5,127,333 A * 7/1992 Theurer ..... E01B 27/20 104/12
5,533,455 A * 7/1996 Theurer ..... E01B 27/16 62/298
5,591,915 A 1/1997 Theurer et al.
(Continued)

FOREIGN PATENT DOCUMENTS

AT 513 973 B1 9/2014
AT 515 801 B1 12/2015
(Continued)

OTHER PUBLICATIONS

International Search Report of PCT/EP2016/002185, dated Feb. 23, 2017.
(Continued)

*Primary Examiner* — Jason C Smith
(74) *Attorney, Agent, or Firm* — Collard & Roe, P.C.

(57) ABSTRACT

Ballast (3) located underneath of sleepers of a track is compacted by immersion and squeezing of compacting tools (7) set in vibrations. The vibrations introduced into the ballast (3) during the compacting process are registered as a measure of the ballast compaction. Thus, it is possible to obtain a homogenously compacted track even in the event of different ballast characteristics.

12 Claims, 2 Drawing Sheets

(56) References Cited

U.S. PATENT DOCUMENTS

Figure 1:
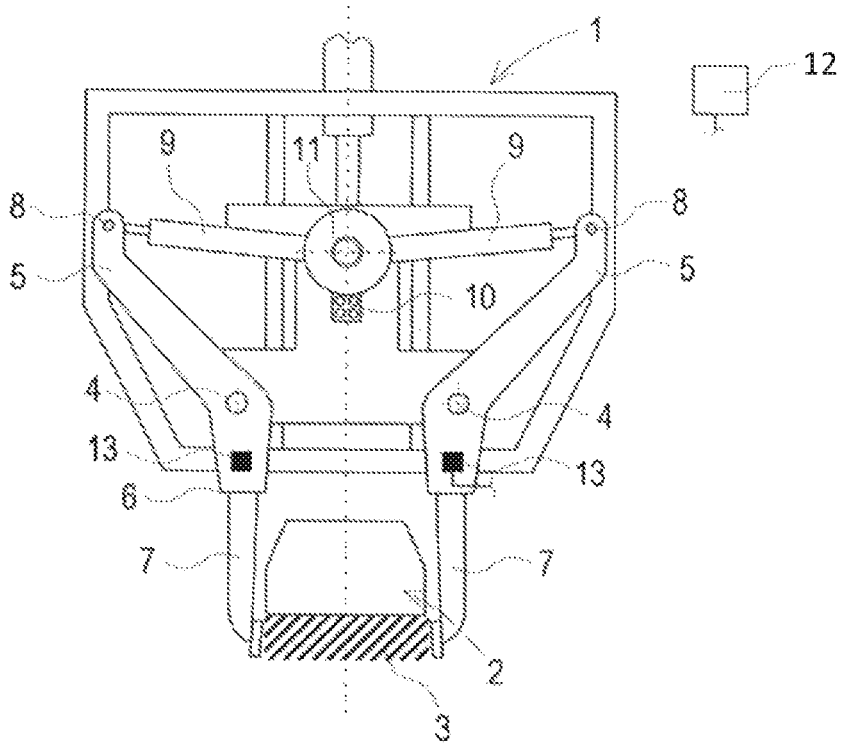

| | | | | |
|---|---|---|---|---|
| 5,736,797 | A * | 4/1998 | Motohashi | H02K 33/16 310/36 |
| 9,957,668 | B2 * | 5/2018 | Lichtberger | E01B 27/16 |
| 2002/0003990 | A1 | 1/2002 | Laugwitz | |
| 2007/0276602 | A1 | 11/2007 | Anderegg et al. | |
| 2015/0267355 | A1 * | 9/2015 | Hofstaetter | E01B 27/16 104/10 |
| 2017/0019012 | A1 * | 1/2017 | Sami | E01B 27/16 |
| 2019/0055698 | A1 * | 2/2019 | Hofstaetter | E01B 27/16 |
| 2019/0234025 | A1 * | 8/2019 | Springer | E01B 27/16 |
| 2019/0271119 | A1 * | 9/2019 | Philipp | B06B 1/18 |
| 2020/0141063 | A1 * | 5/2020 | Philipp | E01B 27/16 |

FOREIGN PATENT DOCUMENTS

| | | | |
|---|---|---|---|
| AU | 2012398058 | A1 | 8/2015 |
| CH | 501 776 | A | 1/1971 |
| CH | 585 314 | A5 | 2/1977 |
| CN | 1054459 | A | 9/1991 |
| CN | 101798784 | A | 8/2010 |
| CN | 103616192 | A | 3/2014 |
| EP | 0 688 902 | A1 | 12/1995 |
| EP | 0 723 616 | B1 | 2/2000 |
| EP | 1 164 223 | A2 | 12/2001 |
| EP | 1 516 961 | A1 | 3/2005 |
| GB | 2 451 310 | A | 1/2009 |

OTHER PUBLICATIONS

Chinese Office Action in Chinese Application No. 201680080130.8, dated Jan. 16, 2020 with English translation.
Austrian Office Action in Austrian Application No. A 34/2016, dated Dec. 5, 2016.

* cited by examiner

METHOD FOR COMPACTING THE BALLAST BED OF A TRACK, AND TAMPING UNIT

CROSS REFERENCE TO RELATED APPLICATIONS

This application is the National Stage of PCT/EP2016/002185 filed on Dec. 29, 2016, which claims priority under 35 U.S.C. § 119 of Austrian Application No. A 34/2016 filed on Jan. 26, 2016, the disclosures of which are incorporated by reference. The international application under PCT article 21(2) was not published in English.

The invention relates to a method for compaction of the ballast bed of a track by means of a compacting tool being set in vibrations, as well as a tamping unit for compacting ballast.

A tamping unit for compacting ballast of a track is known according to AT 513 973 B1. In this, the position of a squeezing cylinder which squeezes compacting tools is detected by means of displacement transducers. The squeezing cylinders are controlled by a path sensor. For achieving an optimal ballast compaction, the vibration amplitude and the vibration frequency of the compacting tools are changed in dependence upon the squeezing position.

AT 515 801 B1 describes a quality number for the ballast hardness. In this, the squeezing force of a squeezing cylinder is represented in dependence upon a squeezing path, and a ratio is defined via the energy consumption. Thus, the energy fed to the ballast via the squeezing cylinder is considered by this ratio. In this manner, however, the energy which is lost in the system is not taken into consideration.

A large part of the energy, however, is used for accelerating and braking the compacting tool. Thus ensues a dependence on the square of the mass inertia and frequency of the vibrating compacting tool. As a result, the said ratio is dependent first of all on the structural design of the compacting tool. Comparability to other compacting tools is thus not possible. It is an essential disadvantage that the ratio does not allow any conclusion with regard to the degree of compaction of the ballast. Strictly speaking, one only receives a ratio for a certain compacting tool.

It is the object of the present invention to provide a method of the type mentioned at the beginning which enables an improved recognisability of the ballast compaction which can be achieved by the compacting tools.

A further object of the invention also lies in providing a tamping unit having vibratable compacting tools which makes a uniform ballast compaction possible.

According to the invention, the object referring to a method is achieved in that the vibrations introduced into the ballast during the compacting process are registered as a measure of the ballast compaction.

By way of the inventive features, it is possible—while advantageously excluding structural energy losses—to register the energy transmitted directly into the ballast and thus to provide a meaningful characteristic value for achieving an optimal ballast compaction. With this, the maximum possible dynamic squeezing power just below a threshold value can be found. As a result, the ballast is not destroyed by excessive compaction, and a very disadvantageous lateral flow-off in the longitudinal direction of the sleepers is reliably precluded. By detecting suitable process data, it is possible to dose in a targeted way the squeezing time and squeezing power required for the desired compaction.

With the features of the method according to the invention, it is possible to generally improve working devices suitable for ballast compaction to the extent that a precise statement (or ratio) with regard to the attainable degree of compaction is possible in each case. With this, it is possible to achieve an optimal state of compaction even in the case of different track-bound compacting-, tamping-, and track stabilizing machines.

The further object mentioned above and referring to a tamping unit is achieved in that an acceleration sensor connected to a control unit is arranged on the tamping lever and/or on the compacting tool.

With such an optimisation of a tamping unit, which can be realized very easily structurally, the energy expense required for the tamping operation is matched to the desired degree of compaction of the ballast, and thus the wear of the latter is reduced. With this invention, it is possible to automatize the tamping process while achieving a homogenous compaction quality and homogenous sleeper beds.

Additional advantages of the invention become apparent from the dependent claims and the drawing description.

Figure 2:
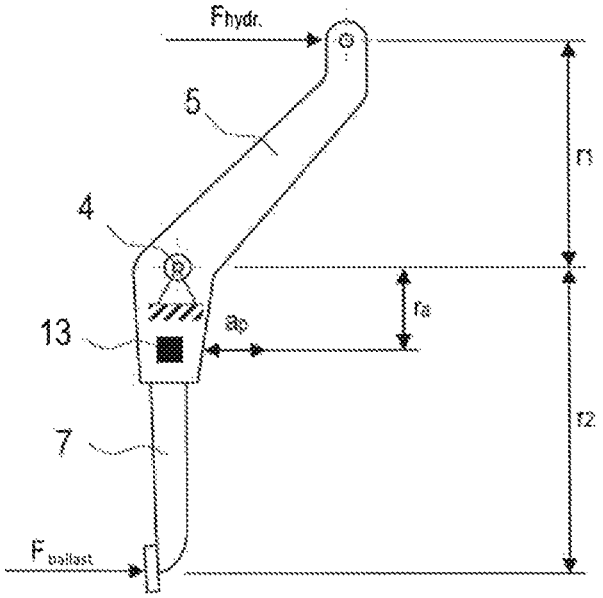
Figure 3:
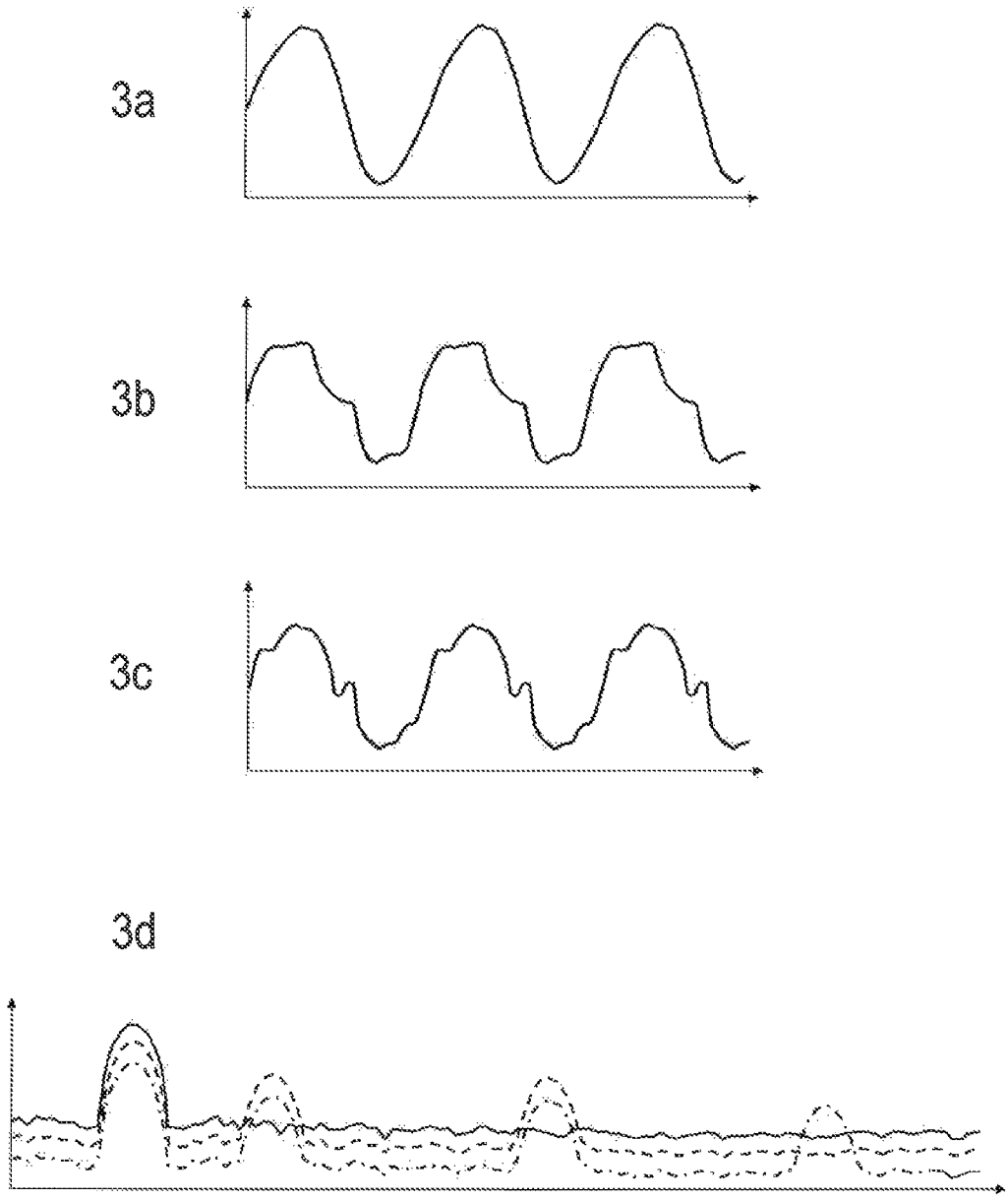

The invention will be described in more detail below with reference to an embodiment represented in the drawing. FIG. 1 shows a simplified side view of a tamping unit having two compacting tools squeezable towards one another, FIG. 2 shows a schematic representation of a compacting tool, and FIG. 3 shows acceleration signals.

A tamping unit 1, shown in a simplified way in FIG. 1, for tamping ballast 3 of a ballast bed, located underneath a track 2, consists essentially of two tamping levers 5, each pivotable about a pivot axis 4. At a lower end 6, these tamping levers 5 are connected in each case to a compacting tool or tamping tine 7 provided for penetration into the ballast 3 and, at an upper end 8, to a hydraulic squeezing drive 9.

Each squeezing drive 9 is mounted on an eccentric shaft 11 which is rotatable by an eccentric drive 10. Thus, oscillating vibrations are produced which are transmitted via the squeezing drive 9, the tamping lever 5 and the compacting tool 7 to the ballast 3 to be compacted. Arranged at the lower end 6 of each tamping lever 5 is an acceleration sensor 13 connected to a control unit 12. Alternatively, however, this could also be fastened directly to the compacting tool 7.

In a further variant of embodiment of the invention, not shown in detail, the acceleration sensor could also be arranged on a compacting tool designed as a track stabilizer setting the track in vibrations.

With the aid of the acceleration sensor 13, the vibrations introduced into the ballast 3 by the compacting tools 7 during the compaction process are registered as a measure of the ballast compaction. To that end, the acceleration forces acting directly on the compacting tool 7 are measured and fed as an acceleration signal to the control unit 12.

The acceleration of the vibrating compacting tool or tamping tine 7 serves as input variable into the system for determining the compaction quality. Normally, the tamping tine 7 does not carry out a harmonic motion but works in non-linear operation. The forces are transmitted to the ballast 3 in only one direction, the ballast stones could lift off the tine surfaces. As a result, jumps occur in the force progression which distort the harmonic acceleration signal.

During a squeezing movement, a maximal possible degree of compaction can be calculated with the acceleration sensor 13 within a time interval. Thus, the information can be obtained that the ballast 3 located between the compacting tools 7 has not yet been compacted up to a maximum degree corresponding to a certain value of the acceleration signal. If needed, an additional tamping sequence can also be initiated. In an advantageous way, it can also be documented that the degree of compaction—particularly during a longer tamping section—has been produced homogenously.

The compacting tools 7 acting as exciters form, together with the ballast 3 as resonator, a system capable of vibration. The resonance of the dynamic system is changed by the compaction since the equivalent stiffness of the system changes. With the aid of the frequency response of the dynamic system, the resonance frequency can be evaluated. It would also be advantageous to track the frequency of this resonance frequency.

An acceleration signal of the acceleration sensor 13 which is emitted to the control unit 12 serves as basis for a harmonic content (HC) and a power of a base vibration (PBV). A power density spectrum or the power spectral density indicates the power of a signal with reference to the frequency in an infinitesimal broad frequency band (limit value towards zero).

The acceleration signals are deformed as soon as a load is present. This is made visible by the calculation of the power density spectrum and summed up in the region below 50 Hz for the power of the base vibration, and over 50 Hz for the power of the harmonics.

The harmonic content (HC) is used as a measure of the ballast compaction. The HC of a harmonic sinus-shaped base signal of the acceleration is influenced by the non-linear behaviour of the retroactive effect (reflexion) of the ballast. The harmonic content is called a dimension-less value and indicates to what measure the power of the harmonics is superimposed on the power of the sinus-shaped base vibration.

In FIG. 3, the results of an analysis of the power spectral density (or PSD, derived from Power Spectral Density) are represented. The curve visible in FIG. 3*a* shows the acceleration signal with non-loaded compacting tool 7, FIGS. 3*b* and 3*c* with medium and high compaction, respectively (on the x-axis the time t is indicated, on the y-axis the acceleration is shown in each case). A comparison shows a significant change in the shape of the sinus function. The spectral portions of the acceleration signal in the harmonics region are increasing.

The progression of the power spectral density of the three presented acceleration signals is shown in FIG. 3*d* (the x-axis corresponds to the frequency Hz, the y-axis to the power density spectrum W/Hz). In the curve shown in full lines, the main frequency portions are around 35 Hz. In the curve drawn in dashed lines, several higher frequency portions are added, and in the curve shown in dash-and-dot lines, even more higher frequency portions are added. These higher frequency portions are responsible for the deformation of the originally sinus-shaped acceleration signal.

For determining the power spectral density, time-limited portions of the acceleration signal are selected and fed to a calculation routine for the power density spectrum. In this way, the power density spectrum is calculated in the frequency band of 5 to 300 Hz.

The power density spectrum is then available as a function over the frequency: $S_{xx}=F\ (2*\pi*f)$ The power is determined in that the power spectral density is integrated over the desired frequency range. The power of the base vibration (PBV) and the harmonics content (HC) are determined as follows:

$$PBV = \int_{f0}^{f1} F(2*\pi*f)df$$

-continued $$HC = \frac{\int_{f1}^{f2} F(2*\pi*f)df}{\int_{f0}^{f1} F(2*\pi*f)df} = \frac{\int_{f1}^{f2} F(2*\pi*f)df}{PBV}$$

By dividing the power of the harmonics by the power of the base vibration (PBV), the harmonics content (HC) is determined which correlates to the existing compaction in the ballast 3. This characteristic value (HC) indicates the magnitude of the power portion of the harmonics in the entire acceleration signal.

A limit frequency f1, lying between the base frequency (PBV) and harmonic, is dependent upon the resonance frequency of the mechanical structure of the tamping unit 1 and is determined by the progression of the power density spectrum (PSD).

The evaluation of an acceleration signal will be described below. The individual measuring values for the squeezing path of the compacting tools 7 and the squeezing duration thereof are divided into several time sections. For the individual portions, the characteristic values for PBV and HC for the front and rear compacting tool 7, with regard to a working direction of a tamping machine, are determined. In an advantageous way, the compaction process or the squeezing motion of the compacting tools 7 can be terminated immediately as soon as the characteristic value HC has reached a pre-set size.

A drive power of the eccentric drive 10 serves for determining an apparent power. Said drive power is registered metrologically by the pressure progression thereof, and the reactive power of the squeezing drives 9 is subtracted, since the power is lost at this place.

An effective power is required for the calculation of squeezing forces of the compacting tools 7. Furthermore, by means of the measured acceleration of the compacting tool 7, the ballast force is determined. The latter is an indicator of the ballast compaction. In principle, the work process of ballast compaction can be divided into the following sections: immersion, squeezing and lifting of the compacting tool 7. The actual compacting process takes place during the squeezing.

During the squeezing motion of the compacting tools 7, the granular structure of the ballast 3 is rearranged. With this, compacting energy is transmitted from the compacting tool 7 to the ballast 3. By means of the energy absorbed in the ballast 3, the rearranging of the granular structure takes place, and in further sequence this leads to a reduction of the pore volume. When the ballast movement underneath the sleeper is finished, the energy absorption of the ballast 3 is reduced. Thereafter, the forces introduced by the compacting tool 7 are reflected more, and the oppositely positioned compacting tool 7 is decelerated more strongly. The stiffness of the ballast 3 increases with growing compaction, and the portions in which energy is absorbed in the ballast 3 (damping) decrease. This results in a greater reaction force to an active force of the compacting tools 7. Thus, if good compaction of the ballast has been attained, an increased power absorption of the compacting tool 7 can be observed.

The measuring value representative of the effective power (the power absorbed by the ballast) can be gained in various ways. For example, the drive power can be measured via the torque and the speed of rotation of the eccentric drive 10, and from this the reactive power consumed in the system itself can be deducted.

Reactive power is caused, on the one hand, by internal friction losses and flow losses in the hydraulic system as well as within the squeezing drives 9, which also serves as force-limiting overload protection in the system. If the force limitation is active, more reactive power is consumed. The reactive power can take place by measurement of the power in the squeezing drive 9. To that end, the resulting cylinder force and the speed of the piston rod relative to the squeezing drive 9 are required. The resulting cylinder force can ensue by means of two pressure sensors in the squeezing drive 9. A displacement transducer in the hydraulic cylinder can be used for determining the speed through one-time differentiation of the path.

The determining of the reactive power of the squeezing cylinder takes place by multiplying the measured pressures with the corresponding surfaces and the speed (differentiated path).

$$F_{hydr} = (r_A * A_A - r_B * A_B)\ B_{squ} = F_{hydr} * \frac{dx}{dt}$$

The reactive power of the squeezing drive 9 is also dependent on the selected squeezing pressure. The overall reactive power can be determined during the putting into operation in dependence on the speed of rotation, squeezing pressure and the apparent power, and can be deposited in a multi-dimensional chart in the computer. Thus, only the determination of the torque and the speed of rotation are required for determining an impact force of the system. The power introduced into the ballast 3 can thus be calculated as follows:

$$P_{ballast} = M_L * 2 * \pi * n_{afi} - B_{squ}$$

In the case of hydraulically driven compacting tools, it can be expedient to use the hydraulic pressure of the eccentric drive 10 for computing the torque, or as a measuring value.

During the initial commissioning of a compacting tool 7, the braking moment or loss moment can be determined by means of special testing scenarios. The power transmitted to the ballast 3 is known at this point. The magnitude of the compacting force, which is an indicator of the generated compaction quality, depends on the accelerations at the compacting tool 7. For calculating the ballast force, a substitute model of the corresponding working device is required; in the case of a tamping machine, this is the compacting tool 7.

The dynamic equation of motion of the tamping lever or tine arm 5 can be represented by the following equilibrium of moments:

$$I_{tinearm} * \frac{\alpha_p}{r_a} - F_{hydr} * r_1 - F_{ballast} * r_2$$

$F_{hydr}$ (see FIG. 2) can either be measured online (in that both chambers of the squeezing drive 9 are equipped with pressure sensors) or also calculated via the drive power of the eccentric drive 10. The acceleration $a_p$ is registered metrologically.

For the next calculation step, the travelled speed and the path of the compacting tool 7 are required. For the speed, the acceleration signal is integrated once, and twice for the path.

The energy flowing into the ballast 3 during compaction by the tamping tine 7 can be described as follows:

$$E_{tine}(L) - \int F_{ballast} * v_{tine}(L) * dt$$

The energy determined in this manner describes the energy consumption of the ballast 3 during the compaction process and indicates a measure for the particular degree of compaction. If the energy input converges towards a certain value, the ballast 3 cannot be compacted any further. In order to be able to compare the degree of compaction of different types of compacting tools 7 to one another, the energy impressed on the tamping tine surface and of the compacting tools 7 in operation is standardized in the following manner.

$$E_{tine,norm}(t) = \frac{1}{A_{tine} * n} * \int F_{ballast} * v_{tine}(t) * dt$$

If the energy input during compaction converges toward zero, then a compaction force is followed by a deformation according to a linear spring characteristic. The ballast 3 does not absorb any more energy, and the physical behaviour is comparable to a stiffness and is used as track ballast E-module.

The stiffness, corresponding to the gradient in a force-path diagram, indicates the elastic behaviour of the ballast 3. The determination of the E-module for the ballast 3 is calculated by means of linear regression line with minimizing the quadratic means.

The invention claimed is:

1. A method for compaction of the ballast bed of a track comprising the following steps:

vibrating a compacting tool, wherein the vibrations introduced into the ballast during the compacting process are registered as a measure for the ballast compaction;

determining an acceleration signal corresponding to an optimal ballast compaction by calculation of the power spectral density (PSD) as a compaction target value, and the compaction process is terminated automatically as soon as the compaction target value is attained calculating a power of the base frequency (PBV) and of the harmonic (PH) by integration of the power spectral density (PSD) over a desired frequency range.

2. A method according to claim 1, wherein acceleration forces effective at the compacting tool are measured and fed as an acceleration signal to a control unit.

3. A method according to claim 1, wherein, for determining the power spectral density (PSD), timely limited sections of the acceleration signal are selected and fed to a calculation routine for a power density spectrum.

4. A method according to claim 1, wherein the power density spectrum is calculated in the frequency band of approximately 5 to approximately 300 Hz.

5. A method according to claim 1, wherein a limit frequency f1, dependent on a mechanical structure of the compacting tool, is determined between a base vibration (BV) and a harmonic (HC) of the acceleration signal.

6. A method according to claim 1, wherein a harmonics content (HC) correlating to the compaction of the ballast is determined by division of the power of the harmonic (PH) through the power of the base vibration (PBV).

7. A method according to claim 1, wherein, by multiplication of the power of the base vibration (PBV) with a factor f specified in dependence of an idling amplitude, a unit utilisation (sL) is determined which allows a conclusion about a ballast condition.

8. A method according to claim 1, wherein, from a pressure progression of an eccentric drive or of a squeezing drive, a drive power of the compacting tool is meteorologically registered, and the same is reduced by the apparent power of the squeezing drives, after which an effective power available at the compacting tool for compacting the ballast is calculated.

9. A method according to claim 8, wherein a compacting power of the compacting tool (tamping tine force) resulting from the effective power is contrasted with a ballast reaction force resulting from the ballast compaction, and the squeezing motion of the compacting tools is automatically terminated after a limit value has been reached.

10. A tamping unit for compacting ballast located underneath a track, comprising:

a plurality of tamping levers, pivotable about a pivot axis, a plurality of compacting tools wherein each of said plurality of tamping levers are connected at a lower end in each case to a compacting tool provided for immersion into the ballast and, a squeezing drive located at an upper end;

an acceleration sensor;

a control unit;

wherein said acceleration sensor is coupled to said control unit and is coupled to at least one compacting tool of said plurality of compacting tools;

wherein said control unit is configured to determine an acceleration signal corresponding to an optimal ballast compaction by calculation of the power spectral density (PSD) as a compaction target value, and the compaction process is terminated automatically as soon as the compaction target value is attained.

11. A tamping unit for compacting ballast located underneath a track, comprising:

a plurality of tamping levers, pivotable about a pivot axis, a plurality of compacting tools wherein each of said plurality of tamping levers are connected at a lower end in each case to a compacting tool provided for immersion into the ballast and, a squeezing drive located at an upper end;

an acceleration sensor;

a control unit;

wherein said acceleration sensor is coupled to said control unit and is coupled to least one tamping lever of said tamping levers;

wherein said control unit is configured to determine an acceleration signal corresponding to an optimal ballast compaction by calculation of the power spectral density (PSD) as a compaction target value, and the compaction process is terminated automatically as soon as the compaction target value is attained.

12. A tamping unit according to claim 11, wherein the acceleration sensor is arranged at the lower end of the tamping lever.

* * * * *